United States Patent [19]

Okubo et al.

[11] Patent Number: 4,614,568

[45] Date of Patent: Sep. 30, 1986

[54] HIGH-SPEED SILVER PLATING AND BATHS THEREFOR

[75] Inventors: Toshikazu Okubo; Yasuo Mori; Shunichi Kasai, all of Toda, Japan

[73] Assignee: Nihon Kogyo Kabushiki Kaisha, Tokyo, Japan

[21] Appl. No.: 617,215

[22] Filed: Jun. 4, 1984

[30] Foreign Application Priority Data

Jun. 14, 1983 [JP] Japan ..... 58-104937
Mar. 13, 1984 [JP] Japan ..... 59-46591

[51] Int. Cl.[4] ..... C25D 3/46; C25D 5/34
[52] U.S. Cl. ..... 204/29; 204/46 R
[58] Field of Search ..... 204/46.1, 43.1, 109, 204/123, 29

[56] References Cited

U.S. PATENT DOCUMENTS

| | | | |
|---|---|---|---|
| 2,429,970 | 10/1947 | Wernlund et al. | 204/46.1 |
| 2,849,352 | 8/1958 | Kirstahler et al. | 204/44 |
| 3,018,232 | 1/1962 | Bishoff et al. | 204/44 |
| 3,245,886 | 4/1966 | Michael | 204/46.1 X |
| 3,257,294 | 6/1966 | Michael | 204/46.1 X |
| 3,267,098 | 8/1966 | Cope | 204/46.1 X |
| 3,296,101 | 1/1967 | Crain | 204/44 |
| 4,247,372 | 1/1981 | Nobel et al. | 204/15 |
| 4,399,006 | 8/1983 | Nobel et al. | 204/29 |
| 4,452,673 | 6/1984 | Takano | 204/29 |

FOREIGN PATENT DOCUMENTS

| | | | |
|---|---|---|---|
| 131382 | 8/1982 | Japan . | |
| 140891 | 8/1982 | Japan . | |
| 43995 | 12/1982 | Japan | 204/46.1 |
| 603709 | 4/1978 | U.S.S.R. | 204/46.1 |

OTHER PUBLICATIONS

The Merck Index, p. 561, (1968).

*Primary Examiner*—G. L. Kaplan
*Attorney, Agent, or Firm*—Seidel, Gonda, Goldhammer & Abbott

[57] ABSTRACT

A high-speed silver plating solution for electroplating silver on a substrate which consists of a less-noble metal, such as copper, copper alloy, copper-plated base metal, iron, ferroalloy, nickel, or nickel alloy, characterized in that a cyclic compound whose ring includes a thioureylene radical

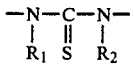

(in which $R_1$ and $R_2$ are hydrogen or an alkyl or aryl group each) is added to the solution in a sufficient amount to prevent silver deposition by displacement reaction, whereby the silver deposition on the substrate is avoided. There is also provided a pretreating solution including the aforementioned compound for dipping the substrate prior to the silver plating.

10 Claims, No Drawings

HIGH-SPEED SILVER PLATING AND BATHS THEREFOR

FIELD OF THE INVENTION

This invention is in the field of a high-speed silver plating, and more specifically to a high-speed silver plating solution and a pretreating solution therefor each of which contains a cyclic compound whose ring includes a thioureylene radical

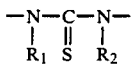

(in which $R_1$ and $R_2$ are hydrogen or an alkyl or aryl group each) so as to avoid silver deposition by displacement reaction on a substrate of less-noble metal, such as copper, copper alloy, copper-plated base metal, iron, ferroalloy, nickel, or nickel alloy etc. than silver, when the substrate is immersed in a high-speed silver plating bath. The aforementioned compound acts as an agent for preventing the silver deposition by displacement reaction, and may be added directly into the plating solution or otherwise may be utilized as pretreating solution into which a substrate is immersed prior to the plating working.

BACKGROUND OF THE INVENTION

Recently, in silver plating electronic parts, high-speed plating process has been in wide use for economic reason. The process uses a high-temperature plating solution with a high silver concentration at a high flow rate to obtain a high silver plating rate. In the high-speed silver plating solution for the process, the free cyanide concentration must be kept properly low. This is because, at a high concentration, the free cyanide will vigorously decompose at an elevated temperature, evolving a dangerous volume of hydrogen cyanide gas. Thus, the high-speed silver plating solution is characterized by the introduction thereinto of a silver salt in the form of an alkali silver cyanide and the provision of a pH buffer system which maintains the pH of the solution in the range of about 7.5 to about 9.0 so that the free cyanide produced from the cathode during the electrolysis is gradually decomposed and removed to prevent its buildup in the solution. The term "free cyanide" as used herein means a cyanide which does not form a complex with a metal ion.

More recently, high-speed partial plating, whereby only the substrate portions desired to be plated are selectively plated at a high speed, is finding acceptance for more effective utilization of the expensive silver. This high-speed partial plating is essentially based on a jet plating technique which comprises masking the substrate portions that need not be plated, pumping a silver plating solution at a high speed and directing it against the exposed portions to be plated, while allowing a current to flow across the substrate and an insoluble anode, thereby to effect silver plating.

A major problem of the high-speed silver plating, particularly the high-speed partial silver plating has been the occurrence of deposition of silver on the less-noble metal substrate by displacement reaction by mere immersion of the substrate in the silver plating solution because of high silver concentration in the plating solution. This deposition of silver by displacement reaction occurs markedly with such metal substrate as copper, copper alloys, copper-plated base metal, iron, ferroalloys, nickel and nickel alloys. The deposits of silver by displacement usually exhibit poor adhesion to the substrate and cause subsequently formed electrodeposits of silver to scale off or, upon heating, blister or tarnish, resulting in defective plating. This is fatal, especially, for the silver plated electronic parts. Moreover, in partial plating, even the portions that need not be plated become plated, consuming the expensive silver wastefully. A further disadvantage is the contamination of the plating bath with ions of copper or other less-noble metal that has dissolved out of the substrate by the displacement reaction with silver.

In order to prevent the formation of low-adhesion silver deposits by immersion, it has been customary to form a thin silver plated layer known as strike from a plating solution with a low silver concentration and then deposit an ordinary plated layer thereon. However, such two-stage plating operation is cumbersome. In the case of partial plating, the strike improves the final plated deposit adhesion to the substrate but necessarily forms the strike layer on the substrate portions that need not be plated, with a loss of silver.

DESCRIPTION OF THE PRIOR ART

In an attempt to prevent this objectionable silver deposition by displacement reaction in the high-speed partial plating, a silver plating solution containing a mercapto-compound has been proposed. (Japanese Patent Application Public Disclosure No. 34699/1980) However, the thiolactic and thiomalic acids the use of which is recommended therein have offensive smell and, moreover, in the presence of copper ions, they tend to become ineffective in preventing the silver deposition by displacement reaction. Therefore, if the copper ion concentration in the plating bath increases, for example, in the silver plating of copper substrates because of copper ion buildup in the bath with the little-by-little progress of silver deposition by displacement, or because of ingress of copper ions from the outside, an effort to arrest the silver deposition by the addition of such a mercaptan compound will fail shortly since its arresting action is only short-lived. This makes the maintenance and control of the plating solution difficult.

As other attempts to suppress the silver deposition by displacement, it has been proposed to use "a silver plating solution containing an aromatic or heterocyclic compound which has a mercapto radical directly bonded to the ring nucleus" (Japanese Pat. App. Pub. Dis. No. 43995/1982) and "a silver plating solution to which dithiocarbamic acid or a salt thereof and/or thiosemicarbazide or a salt thereof has been added, and a pretreating solution using such compound" (Japanese Pat. App. Pub. Dis. No. 131382/1982 and No. 140891/1982).

The compounds proposed by these prior inventions, when added to silver plating solutions with high free cyanide concentrations, will prevent the silver displacement deposition on less-noble metal substrates. On the other hand, in silver plating solutions with free cyanide contents low enough for high-speed plating, they will form scarcely soluble precipitates and will not prove effective in preventing the displacement deposition of silver. In the case where such compound is utilized as a pretreating solution, such compound is adsorbed by the substrate surface and forms a film to prevent silver deposition by immersion. It often forms a too thick film, however, thereby adversely influencing subsequent silver plating with unevenness in color or other defect.

THE OBJECT OF THE INVENTION

As explained above, the prior art techniques are not fully satisfactory, so far as the high-speed silver plating including partial plating is concerned, in avoiding the silver deposition by immersion, thereby producing a plated silver deposit with good adhesion, and averting the loss of silver.

The present invention aims to overcome the problems of the prior art. More specifically, the object of this invention is to provide silver plating with good adhesion to the substrate without the need for silver strike in a high-speed silver plating solution having a sufficiently low concentration of free cyanide.

SUMMARY OF THE INVENTION

The inventors discovered that a cyclic compound whose ring includes a thioureylene radical

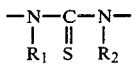

(in which $R_1$ and $R_2$ are hydrogen or an alkyl or aryl group each), is very excellent as an agent for preventing silver deposition by displacement reaction. This compound is extremely effective in preventing the silver deposition by displacement reaction. It does not give any offensive smell and its favorable effect is scarcely weakened by the presence of Cu ions. It may be added, without any possibility of forming a precipitate, to a high-speed silver plating solution having a properly low free cyanide concentration. In addition, this compound, when is utilized as a pretreating solution, forms a thin and uniform film on a substrate, resulting in harmless affects to subsequent plating operation.

This invention may be embodied in the form of a plating solution to which this compound is added or otherwise embodied in the form of a pretreating solution utilizing the compound.

This invention, in its first aspect, provides a high-speed silver plating solution for electroplating silver on a substrate which consists of a less-noble metal, such as copper, copper alloy, copper-plated base metal, iron, ferroalloy, nickel, or nickel alloy, characterized in that a cyclic compound whose ring includes a thioureylene radical

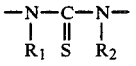

(in which $R_1$ and $R_2$ are hydrogen or an alkyl or aryl group each) is added to the solution in a sufficient amount to prevent silver deposition by displacement reaction, whereby the silver immersion deposition on the substrate is avoided.

Further, this invention, in the second aspect, provides a pretreating solution for silver plating into which a substrate is dipped prior to silver plating in order to prevent silver deposition by displacement reaction in the electroplating of silver on the surface of the substrate which consists of a less-noble metal, such as copper, copper alloy, copper-plated base metal, iron, ferroalloys, nickel or nickel alloys, characterized in that the pretreating solution contains a cyclic compound whose ring includes a thioureylene radical represented by

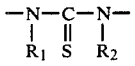

(in which $R_1$ and $R_2$ are hydrogen or an alkyl or aryl group each).

DETAILED EXPLANATION OF THE INVENTION

The cyclic compound to be employed in the present invention with a ring structure including a thioureylene radical

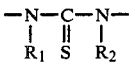

(in which $R_1$ and $R_2$ are hydrogen or an alkyl or aryl group each) has N atoms attached to the both sides of the thione group and is cyclic per se. Therefore, it is stable with very little slight decomposition under the rigorous conditions encountered in high-speed plating, namely, high temperature, high flow rate, and high current density. In contrast with this, the noncyclic compound even with the same thioureylene radical and also the compounds that are cyclic but do not have N atoms attached to the both sides of the thione group are easily decomposed by the conditions under which high-speed plating is carried out. Especially stable against such a decomposition reaction is a cyclic compound including a thioureylene radical

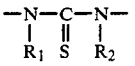

with a ring structure of either 5 or 6 members in which the other atom is either C or N.

Typical of these compounds includes 2-imidazolidine thione, 2-thiobarbituric acid, 1-phenyl-2-tetrazoline-5-thione, and their derivatives.

Explanations will be made separately divided into a plating solution and a pretreating solution.

PLATING SOLUTION

The amount of such a cyclic compound to be added may be just necessary and enough to prevent silver deposition by immersion. Usually, an amount in the range of 10 to 300 mg per liter of the bath is adequate.

Such a compound, when contained in a high-speed silver plating solution with a properly low free cyanide concentration in an amount of 0.05 g/l will completely preclude the displacement deposition. Under certain conditions, a smaller content of only 0.02 g/l will still give satisfactory result.

The silver plating solution in accordance with the present invention is a high-speed silver plating solution having a silver concentration, in the form of an alkali silver cyanide, of 10 to 100 g/l and a free cyanide concentration of not more than 10 g/l. Among alkali silver cyanides, potassium silver cyanide gives the best result. In addition, the silver plating solution may contain boric acid or an alkali metal salt of phosphoric, pyrophosphoric, or citric acid as a salt effective in improving the electric conductivity of the solution and in buffering the pH of the solution within the range of 7.5 to 9.0.

The high-speed silver plating solution of the invention may be used with an ordinary equipment under the same conditions as in conventional high-speed plating. For example, the concentration of the silver salt may range, in terms of silver, from 50 to 80 g/l, the bath temperature from 40° to 80° C., the current density from 20 to 200 A/dm$^2$, and the pH from 7.5 to 9.0. High-speed plating at an appropriate flow rate under these conditions will produce a plated silver deposit highly adherent, uniform and smooth with low hardness, which is optimum as plated silver deposit for electronic parts. The brightness is low, but if a highly bright silver plating deposit is to be had, it is only necessary to add a brightener such as selenium compound. It is also not objectionable, according to the use intended, to add an antimony compound, EDTA, and/or other ingredient known to those skilled in the art so as to improve the properties of the electro plated deposit or the plating conditions.

As described above, the high-speed silver plating solution of the invention prevents silver deposition by displacement reaction when silver is plated on a substrate of a less-noble metal, such as copper, copper alloy, iron, ferroalloy, nickel, or nickel alloy at a high speed. Consequently, adhesion of the plated deposit to the substrate is enhanced, and the loss of silver can be precluded. This effect is not marred by the presence of impurities such as Cu ions, and the plating bath is quite easy to control; replenishment of consumed ingredients from time to time and filtration through activated charcoal at regular intervals of operation will make the plating solution useful semipermanently.

PRETREATING SOLUTION

The pretreating solution according to the present invention is used with a substrate of copper, copper alloy or other metal less noble than silver, after alkali degreasing and acid pickling in the manner well known to those skilled in the art. The substrate has only to be dipped in the pretreating solution for 3 to 30 seconds. Between this pretreatment and silver plating a step of water washing may be interposed, but the practice of silver plating immediately after the pretreatment without the intermediate water washing does not present problems at all.

The pretreating solution of the invention may be any aqueous or alcoholic solution capable of dissolving a cyclic compound whose ring includes a thioureylene radical represented by

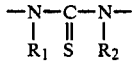

(in which $R_1$ and $R_2$ are hydrogen or an alkyl or aryl group each). When the carry-over of the solution into the silver plating bath, which is made alkaline by a cyanide, is taken into consideration, it is desirable to use an alkaline solution usually containing about 0.1 to 20 g of KOH or NaOH per liter.

In this pretreating solution, the amount of the aforementioned cyclic compound has only to be necessary and sufficient for the prevention of silver deposition by displacement reaction. Generally, the compound content in the range of 0.01 to 30 g/l gives satisfactory result.

The pretreating solution of the invention for silver plating does not form such a thick film on the substrate surface that can result in ununiform coloring. Also, because the solution does not form a scarcely soluble compound with the silver ion, it will not produce a precipitate even when carried into a high-speed silver plating bath. For these reasons the pretreating and silver plating solutions can be controlled with utmost ease.

When the agent for preventing silver deposition by displacement is added directly into a plating solution, there is an advantage of shortened process time, because the pretreatment for the prevention of silver deposition by displacement may be eliminated. For long-term operation, however, separating the process into pretreatment and plating steps is advantageous in the following respects:

(1) The substrate, when dipped in a silver plating bath, is protected against the dissolution into the bath of the base metal that will otherwise occur during the very short period of time before the agent for preventing the silver deposition by displacement begins to become effective.

(2) Mixing of the agent for preventing the silver deposition by displacement into the silver plating solution is avoided.

(3) Consequently, the ingress of any ingredient of the agent for preventing the silver deposition by displacement into the plated silver deposit is avoided, too.

(4) Further prevention of any deleterious effect upon the plating operation that could result from the ingress of the agent into the silver plating bath is rendered possible.

As described above, the pretreating solution of the invention is used, prior to high-speed silver plating, on a substrate of less-noble metal, for example, copper or copper alloy, whereby an effect preventive of silver deposition by displacement at the time of silver plating is attained, adhesion of the electrodeposit to the substrate is enhanced, and the loss of silver can be decreased.

The silver plated layer, formed by silver electroplating the substrate pretreated in conformity with the invention, is highly adherent, uniform and smooth with low hardness and is optimum as such for electronic parts.

Examples of the invention will now be explained.

EXAMPLE 1

A high-speed silver plating solution of the following composition was prepared:

| | |
|---|---|
| $KAg(CN)_2$ | 120 g/l |
| $K_2HPO_4$ | 90 g/l |
| 2-Thiobarbituric acid | 50 mg/l |

This solution was adjusted to pH 8.3. A phosphor bronze sheet which had been alkali degreased and acid pickled in the usual manner was immersed into the bath. No silver deposition was observed on the phosphor bronze sheet. The same plating solution was used in high-speed partial plating of a similarly pretreated phosphor bronze sheet by the jet plating method. The current density was 100 A/dm$^2$, and the bath temperature was 65° C. The silver deposit thus obtained was uniform, smooth, and low in hardness. With good adhesion to the substrate, it showed no change in outward appearance, such as blister, after heating at 350° C. for 2 minutes.

EXAMPLE 2

In example 1, the 2-thiobarbituric acid was replaced by 30 mg/l of 2-imidazolidine thione, and the same experiment was conducted. The result was substantially the same as in the preceding example.

EXAMPLE 3

A high-speed silver plating solution of the following composition was prepared:

| | |
|---|---|
| $KAg(CN)_2$ | 120 g/l |
| $K_4P_2O_7$ | 70 g/l |
| $H_3BO_3$ | 30 g/l |
| 1-phenyl-2-tetrazoline-5-thione | 30 mg/l |

This solution was adjusted to pH 8.3, and a phosphor bronze sheet, conventionally alkali degreased and acid pickled before-hand, was immersed into this bath. There occurred no silver deposition on the phosphor bronze sheet.

With the high-speed silver plating solution of the above composition, high-speed partial plating of a similarly pretreated phosphor bronze sheet was performed by the jet plating technique with a current density of 100 A/dm$^2$ at 65° C. The plated silver deposit so formed was uniform, smooth, and desirably adherent to the substrate. Heating at 350° C. for 2 minutes caused no change in the outward appearance, by blister or otherwise, of the plated deposit.

Experiments similar to those of Examples 1 to 3 were conducted but with solutions free, respectively, from 2-thiobarbituric acid, 2-imidazolidine thione, or 1-phenyl-2-tetrazoline-5-thione. In all runs poorly adherent silver deposits were formed by immersion.

COMPARATIVE EXPERIMENTS 1

A high-speed silver plating solution of the following composition was prepared:

| | |
|---|---|
| $KAg(CN)_2$ | 120 g/l |
| $K_2HPO_4$ | 90 g/l |

This was adjusted to pH 8.3. The compounds shown in Table 1 were added to aliquots of the solution to a concentration of 100 mg/l each, and the resulting solutions were used in high-speed partial plating by the jet plating method.

TABLE 1

| Compound | Formation of precipitate | Displacement deposition preventive effect |
|---|---|---|
| This invention: | | |
| 2-Thiobarbituric acid | No | O |
| 2-Imidazolidine thione | No | O |
| I-Phenyl-2-tetazoline-5-thione | No | O |
| Comparative Examples: | | |
| Sodium 2-mercaptobenzothiazole | Yes | X |
| 1,3-Diphenyl-2-thiourea | Yes | X |
| 1-Acetyl-2-thiourea | No | X |
| Sodium ethylxanthogenate | Yes | X |
| Sodium diethyl dithiocarbamate | Yes | X |
| Thioacetamide | Yes | X |
| Succinimide | No | X |
| Polyethyleneimine | No | Δ |
| No additive: | No | X |

The symbols in the column "displacement-deposition-preventive effect" denote the following:
O = No silver deposition by displacement reaction and no color change of the phosphor bronze sheet tested.
Δ = Partial silver deposition and partial whitening of the phosphor bronze sheet.
X = Silver deposition on the entire substrate surface and complete whitening of the sheet.

As is obvious from Table 1, the additives according to the invention, namely, 2-thiobarbituric acid, 2-imidazolidine thione, and 1-phenyl-2-tetrazoline-5-thione did not form any precipitate. Some of the additives mentioned as comparative examples gave precipitates. Phosphor bronze sheets alkali degreased and pickled beforehand in the usual manner were dipped in these high-speed silver plating solutions for 30 seconds. The effects of those additives in preventing the silver deposition were as summarized in Table 1.

Using the high-speed silver plating solutions that caused the silver deposition by displacement reaction, high-speed partial silver plating of pretreated phosphor bronze sheets was accomplished under the same conditions as those in Example 1. The substrate portions that needed no plating had large silver deposits. Moreover, the plated silver deposits looked quite uneven and ununiform and had poor adhesion to the substrates. They tarnished and blistered on heating at 350° C. for 2 minutes.

COMPARATIVE EXPERIMENTS 2

A high-speed silver plating solution of the same composition as that for Comparative Experiments 1 was prepared and phosphor bronze sheets were dipped in the solution to dissolve out the copper ions. To aliquots of this solution were added, respectively, 50 mg/l each of (a) thiolactic acid
(b) thiomalic acid
(c) 2-thiobarbituric acid
(d) 2-imidazolidine thione
(e) 1-phenyl-2-tetrazoline-5-thione.

Conventionally alkali degreased and pickled phosphor bronze sheets, when placed in these solutions, formed no silver deposit by immersion. Further, high-speed partial plating with these silver plating solutions were carried out under the same conditions as used in Example 1. Desirable silver plated deposits were obtained.

The silver plating solutions were than allowed to stand for 72 hours. Phosphor bronze sheets, likewise pretreated, were dipped in these baths. With the solutions containing thiolactic acid or thiomalic acid, poorly adherent silver deposits by displacement resulted from immersion. Further high-speed plating yielded silver deposits of poor adhesion, mostly uneven in the outward appearance.

On the other hand, the solutions that contained the additives of the invention, 2-thiobarbituric acid, 2-imidazolidine thione, or 1-phenyl-2-tetrazoline-5-thione, even after 72 hours of standing, completely prevented the silver deposition by displacement on the pretreated phosphor bronze sheets. High-speed plating also afforded plated silver deposits as desirable as those formed before the standing. Similar results were attained even after standing for 240 hours or more.

EXAMPLE 4

Two phosphor bronze sheets, alkali degreased and acid pickled beforehand in the usual manner, were prepared, and one of them was pretreated by dipping in an aqueous solution containing one gram of 2-imidazolidine thione per liter for 10 seconds.

The two phosphor bronze sheets were immersed in a silver plating solution, containing

| | |
|---|---|
| $KAg(CN)_2$ | 130 g/l |
| $K_2HPO_4$ | 100 g/l |

and adjusted to pH 8.5, at 60° C. for 30 seconds. No silver deposition by immersion occurred on the pretreated phosphor bronze sheet nor any tarnishing of the phosphor bronze surface took place. The other phosphor bronze sheet, not pretreated, showed silver immersion deposit, dull and white, over the entire surface.

Also, a phosphor bronze lead frame, degreased and pickled in the same manner as above, was pretreated by a dip for 10 seconds in an aqueous solution containing 1 g/l of 2-imidazolidine thione. The pretreated lead frame was partially plated with the above silver plating solution at a high speed by the jet plating technique to form a plated layer 3.0 μm thick. The current density used was 80 A/dm$^2$ and the bath temperature was 70° C.

The plated silver deposit thus obtained had no outward defect such as ununiform color and was of high purity with low brightness. With good adhesion it underwent no undesirable change in outward appearance, such as tarnishing or blister, upon heating at 400° C. for 2 minutes.

What is claimed is:

1. A high-speed silver plating solution for electroplating silver on a substrate which consists of a less-noble metal, such as copper, copper alloy, copper-plated base metal, iron, ferroalloy, nickel, or nickel alloy, said plating solution comprising silver salt in the form of an alkali metal silver cyanide, a free cyanide concentration of not more than 10 g/l, the solution containing a buffering agent so that the pH of the solution is adjusted within the range of 7.5 to 9.0, and a cyclic compound whose ring includes a thioureylene radical

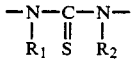

(in which $R_1$ and $R_2$ are hydrogen or an alkyl or aryl group each) in a sufficient amount to prevent silver deposition by displacement reaction, whereby the silver deposition on the substrate is avoided.

2. A high-speed silver plating solution according to claim 1, wherein the cyclic compound whose ring includes a thioureylene radical

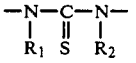

(in which $R_1$ and $R_2$ are hydrogen or an alkyl or aryl group each) has a ring structure of either 5 or 6 members in which the other atoms composing thr ring are either C or N.

3. A high-speed silver plating solution according to claim 2, wherein the cyclic compound whose ring includes a thioureylene radical

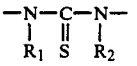

(in which $R_1$ and $R_2$ are hydrogen or an alkyl or aryl group each) is 2-thiobarbituric acid, 2-imidazolidine thione, 1-phenyl-2-tetrazoline-5-thione, or a derivative thereof.

4. A high-speed silver plating solution according to claim 1, wherein the silver plating solution contains not more than 100 g/l of silver in the form of an alkali silver cyanide.

5. A high-speed silver plating solution according to claim 1, which contains a salt, selected from among alkali metal salts of phosphoric, pyrophosphoric, and citric acids, to impart electric conductivity and pH bufferability to the solution, and the pH of the solution is adjusted within the range of 7.5 to 9.0.

6. An electrolytic plating solution for plating silver onto a surface of cooper comprising an alkali metal silver cyanide and 2-thiobarbituric acid.

7. An electrolytic plating solution for plating silver onto a surface of metal less noble than silver comprising an alkali metal silver cyanide and a compound selected from the group consisting of 2-thiobarbituric acid, 2-imidazolidine thione, 1-phenyl-2-tetrazoline-5-thione, and a derivative thereof.

8. An electrolytic plating solution according to claim 7, in which the compound is 2-thiobarbituric acid.

9. An electrolytic plating solution according to claim 7, in which the compound is selected from the group consisting of 2-imidazolidine thione, 1-phenyl-2-tetrazoline-5-thione, and a derivative thereof.

10. An electrolytic plating process for plating silver on a surface of metal less noble than silver comprising treating the metal surface with a compound selected from the group consisting of 2-imidazolidine thione, 1-phenyl-2-tetrazoline-5-thione, and derivatives thereof and plating the metal surface in an electrolytic plating solution containing an alkali metal silver cyanide.

* * * * *